US006105770A

United States Patent [19]

Vasudeva

[11] Patent Number: 6,105,770

[45] Date of Patent: Aug. 22, 2000

[54] TOOL CONTAINER WITH PIVOTABLE COMPONENT HOLDER

[75] Inventor: Kailash C. Vasudeva, Waterloo, Canada

[73] Assignee: Maxtech, Inc., Roseville, Mich.

[21] Appl. No.: 09/129,768

[22] Filed: Aug. 6, 1998

Related U.S. Application Data

[63] Continuation-in-part of application No. 08/979,879, Nov. 26, 1997, abandoned

[60] Provisional application No. 60/054,935, Aug. 8, 1997, and provisional application No. 60/077,470, Mar. 10, 1998.

[51] Int. Cl.[7] ..... B65D 85/20; B65D 79/00

[52] U.S. Cl. ..... 206/378; 206/748; 206/749; 206/755; 206/759; 206/379

[58] Field of Search ..... 206/749, 751, 206/754, 755, 759, 378, 372, 379, 45.13, 748, 377, 376

[56] References Cited

U.S. PATENT DOCUMENTS

| | | | |
|---|---|---|---|
| 1,732,214 | 10/1929 | Amez-Droz | 206/754 |
| 1,859,401 | 5/1932 | Lengsfield | 206/751 |
| 1,966,351 | 7/1934 | Lewis | 206/749 |
| 2,403,825 | 7/1946 | Nissenbaum | 206/379 |
| 2,427,218 | 9/1947 | Liebson | 206/755 X |
| 2,589,593 | 3/1952 | Andersen et al. . | |
| 3,074,539 | 1/1963 | Rogovin | 206/379 |
| 3,086,645 | 4/1963 | Yount . | |
| 4,006,821 | 2/1977 | Sautter . | |
| 5,244,265 | 9/1993 | Chiang . | |
| 5,533,625 | 7/1996 | Mikkelsen . | |

FOREIGN PATENT DOCUMENTS

| | | | |
|---|---|---|---|
| 656952 | 2/1938 | Germany . | |
| 16850 | 10/1898 | Switzerland | 206/45.13 |
| 404074 | 1/1934 | United Kingdom | 206/45.13 |

*Primary Examiner*—Bryon P. Gehman
*Attorney, Agent, or Firm*—R. Craig Armstrong

[57] ABSTRACT

A tool container, such as a toolbox or gift case, has at least one pivotable component holder pivotally mounted therein for pivoting movement between a storage position and an access position. The pivotable component holders are biased towards the access position when the lid is open. The tool container brings an element directly or indirectly into contact with at least one of the pivotable component holders to rotate it to the storage position when the lid closes, with no direct connection between the lid and the pivotable component holders. Where there are multiple pivotable component holders, they may be ganged together, for example via a gang bar. Instead of rotation of the pivotable component holders being triggered by lid closure, such rotation could be triggered by removal or storage of the tool for which the components are intended. Pivotable holder components may be manipulated manually between storage and access positions when the lid is open and movement may be independent of the lids position.

16 Claims, 17 Drawing Sheets

TOOL CONTAINER WITH PIVOTABLE COMPONENT HOLDER

REFERENCE TO RELATED APPLICATIONS

This application is related to and claims the benefit of: a provisional application filed on Aug. 8, 1997, Ser. No. 60/054,935; a formal application filed on Nov. 26, 1997, Ser. No. 08/979,879, now abandoned claiming priority from that provisional application, this application being a continuation-in-part of that formal application; and a further provisional application filed on Mar. 10, 1998, Ser. No. 60/077,470.

BACKGROUND OF THE INVENTION

This invention relates to toolboxes and tool cases, particularly ones in which sockets, bits and/or other such tool components are stored for use with corresponding tools such as socket wrenches, screwdrivers, drills, small power tools, etc., which may or may not be stored in the same toolbox or tool case. Such cases include but are not limited to those cases commonly referred to as "gift cases" or "socket cases", i.e. cases which act as point-of-purchase holders and which may also serve as permanent holders, and larger toolboxes which may have multiple drawers, for example.

Cases of these general types are well known. A gift case typically includes an open-topped box portion and a lid hinged to the box portion, with a clip, a clasp or the like to hold the lid shut. Various means are provided within such cases for holding tools and components, such as a socket wrenches/ratchets and sockets, or a screwdriver and various bits therefor, as two examples.

In the larger toolboxes, there may be a unit with multiple drawers, and commonly a storage area on top of the unit, with a hinged lid which can be raised to gain access.

In these toolboxes or tool cases, hereinafter simply referred to as tool containers, it is common to have multiple recesses for tool components, such as sockets. When such recesses are oriented parallel to the main plane of the container, it can be difficult to remove the sockets. When oriented at an angle to the main plane of the container, so as to be more accessible, a snug fit is normally employed to prevent the sockets from being dislodged when the tool container is carried around. In either case, this makes the sockets difficult to remove, especially with greasy or oily hands.

For convenience, the word "sockets" will be used throughout this specification. However, it should be clearly understood that the invention is clearly applicable to tool components other than sockets, and the use of the word "socket" is not intended to exclude bits, wrenches, screwdrivers, power tools accessories or other such components.

In general, there remains a need for tool containers which provide secure storage for tool components when desired, and yet easy access to the components when required.

SUMMARY OF THE INVENTION

It is thus an object of the invention to provide a tool container which provides secure storage for tool components when desired, and yet easy access to the components when required.

In particular, it is an object of the invention to provide a tool container with tool component holders which are rotatable between a storage position and an access position where improved access to the components is provided. The component holders are configured to rotate upon opening the lid of the tool container, or in one embodiment by removing a tool, but are not directly linked to the lid, as explained in detail below. In all circumstances, in the case when jamming occurs the component holders may be manually rotated into the storage or access position.

BRIEF DESCRIPTION OF THE DRAWINGS

The invention will now be described in detail with reference to the accompanying drawings, in which.

DETAILED DESCRIPTION OF THE PREFERRED EMBODIMENTS

Figure 1:
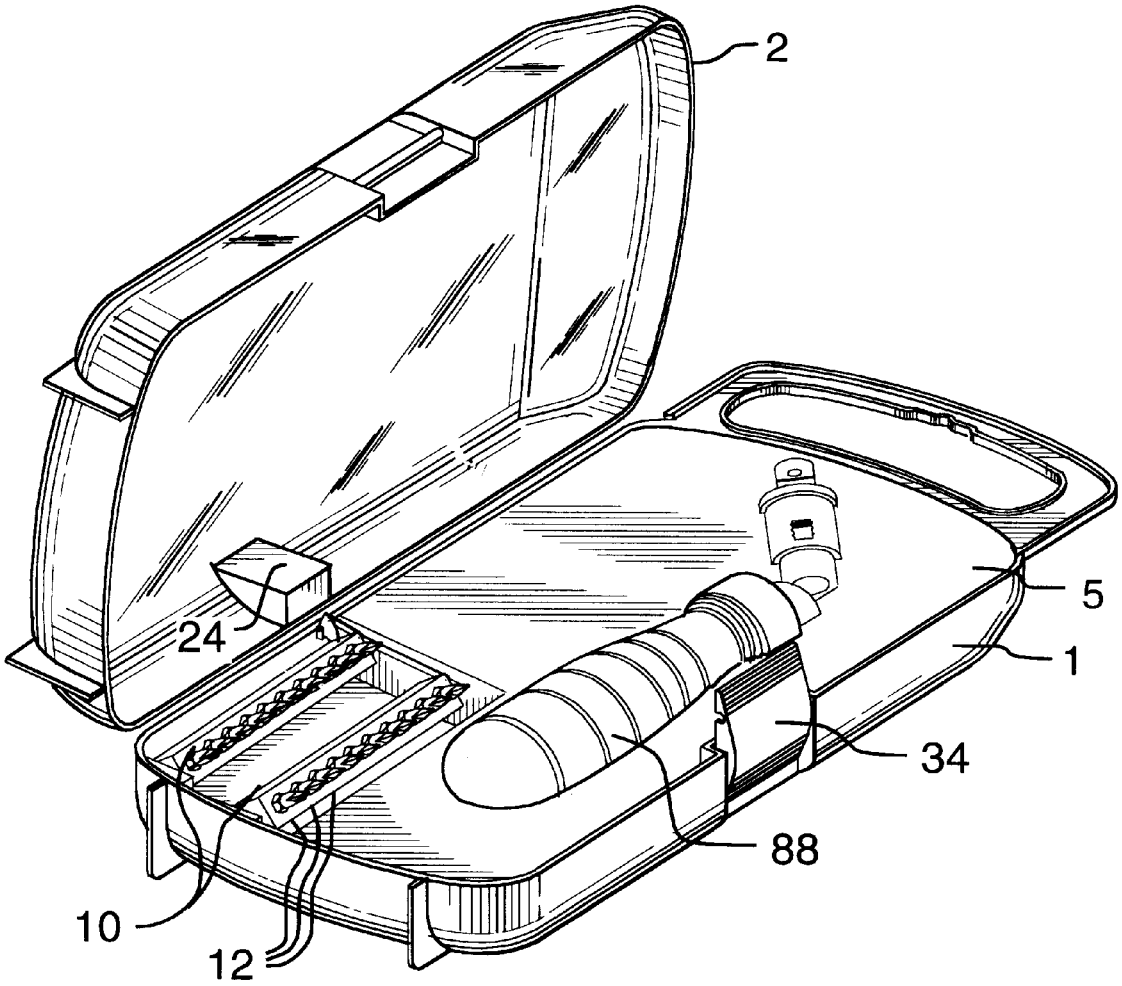
FIG. 1 is a perspective view of a preferred embodiment of a tool case.
Figure 2:
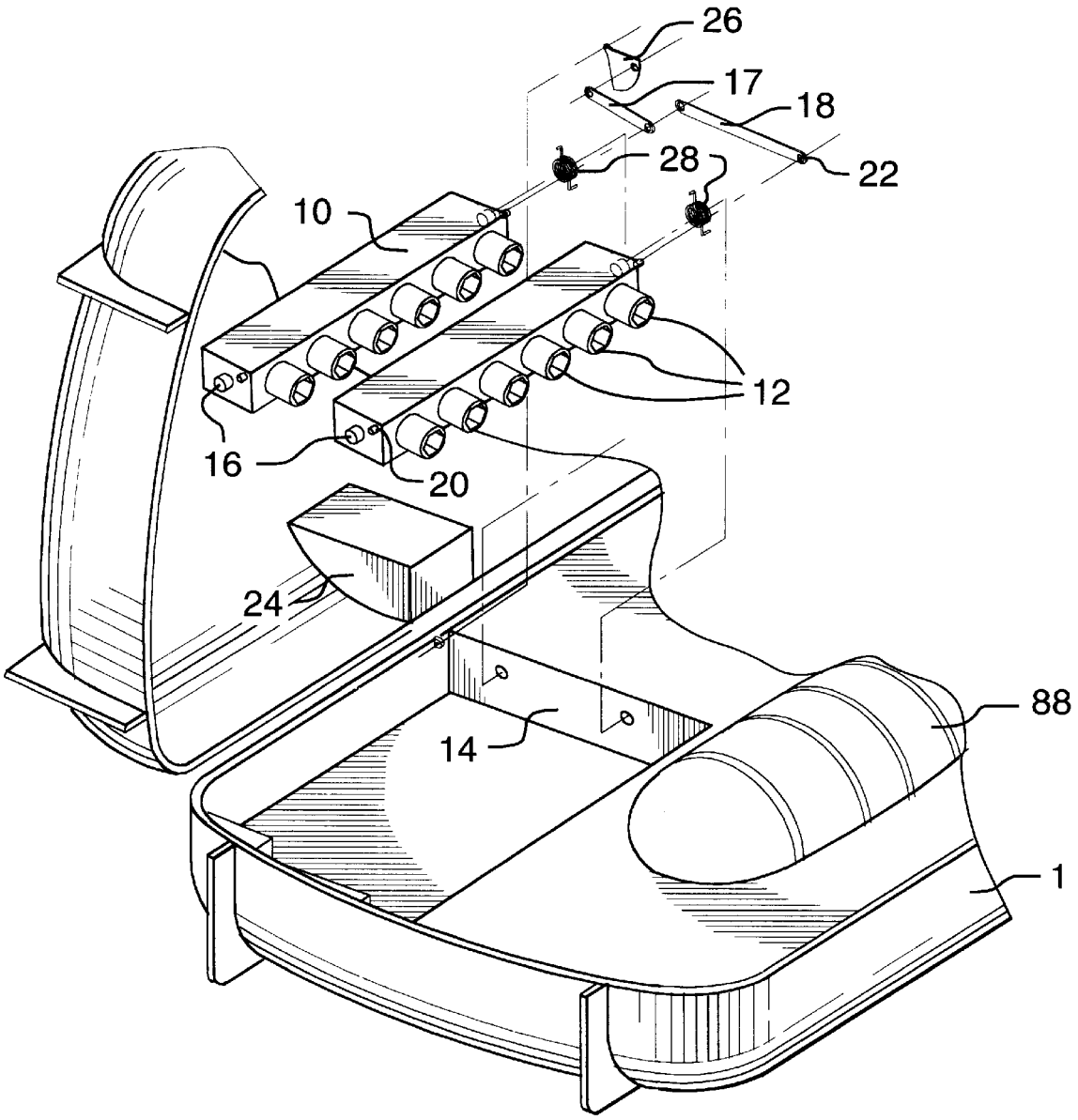
FIG. 2 is an exploded perspective of the FIG. 1 tool case, showing the various components of the mechanism of the pivotable component holders.

The tool case of the invention, shown in FIGS. 1–6, includes a main box portion 1 and a lid 2 hinged to the box portion, for example by two hinges 3. Alternatively, the lid may be latched, rather than being hinged, onto the box portion. A clip 34 or other suitable securing means holds the lid shut in conventional fashion. The main box portion typically is blow molded or injection molded. A panel 5 positioned in the box portion has various recesses defined therein to accommodate tools, such as a ratchet or other large tool 88. Various sockets or other components 12 may be stored in such recesses as well, or as in the invention, may be stored in pivotable holders 10. Each pivotable holder has a number of component-holding clips, posts, recesses 11 or other suitable means, or may simply be a small bin or number of bins.

In toolboxes such as those shown in FIGS. 7–15, trays 8 positioned in the storage areas (i.e. whether the upper storage area or the drawers) have similar pivotable holders 10. Each pivotable holder has a number of component-holding recesses 11, to hold components 12 such as sockets, for example. The trays may be fixed in place, or may be removable. If removable, the trays preferably should be provided with a manual locking means, as in or similar to the FIGS. 17A–17B means described below, so that the component holders can be locked in their storage position notwithstanding the fact that the lid has been raised.

As with the tool cases, the toolbox I has a lid 2 hinged thereto. The lid is typically but not necessarily constrained by linkage arms 3 which pivot at elbow joints 4, as in the embodiment of FIGS. 11–15. Opening the lid reveals an upper storage area 5. Multiple drawers 6 are aligned beneath the upper storage area, and constitute additional storage areas which may or may not contain additional trays.

Each pivotable holder is pivotally mounted in side walls 14 of either a large recess (in the case of a tool case) or a tray 8 (in the case of a toolbox), via pivot pins 16. Various means may be employed to move the pivotable holders between a storage position when the storage area is closed, and an access position where the sockets or other components are more easily accessible. In the storage position, the sockets will normally but not necessarily be generally parallel to the main plane of the storage area, which in most cases is a horizontal plane (but see the embodiment of FIGS. 16A–16D and 17A–17B, which is also within the scope of the invention). In the access position, the sockets will be angled outwardly from that plane, for easier access.

Figure 21:
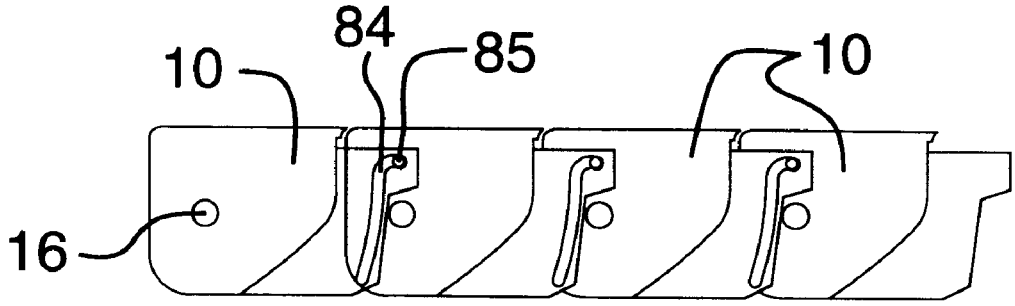
FIGS. 21 and 22 are side views showing an alternative means of ganging the component holders together.
Figure 22:
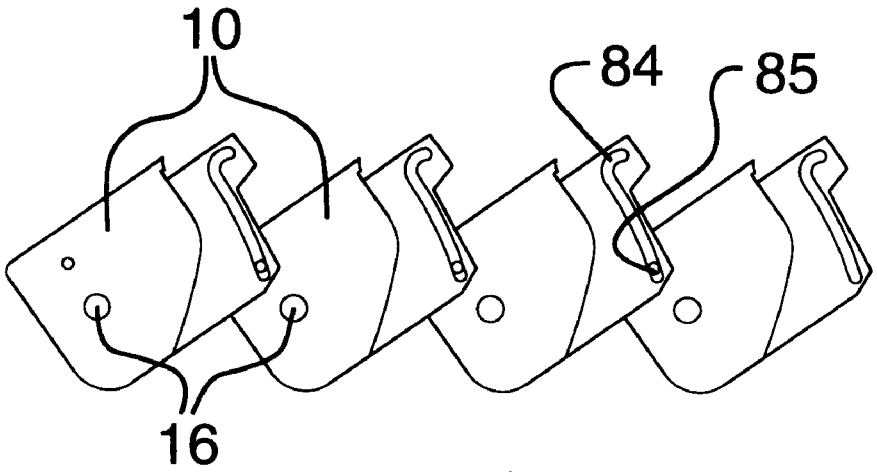
Figure 23:
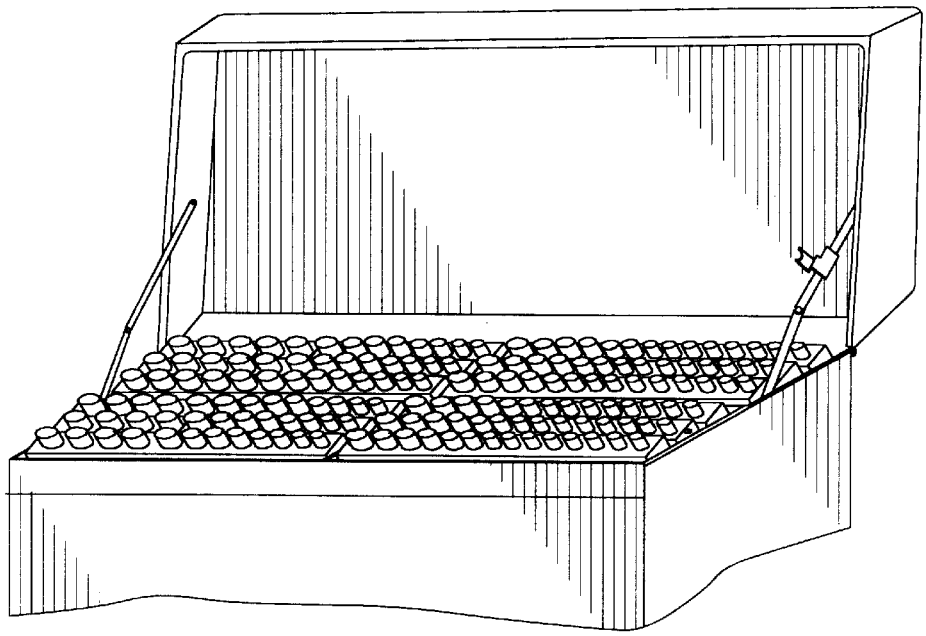
FIG. 23 is a perspective view of a third embodiment of a toolbox, wherein a component holder tray is detachable from a main tray positioned within the toolbox.

If there are several pivotable holders, as in the preferred embodiments, then ganging means such as a gang bar 18, or two gang bars 18 (one on each side) may be used to connect the pivotable holders, via gang pins 20 which fit into holes 22 in the gang bar or bars. FIGS. 21 and 22, described in greater detail below, show one of many possible alternative ganging means.

Figure 3:
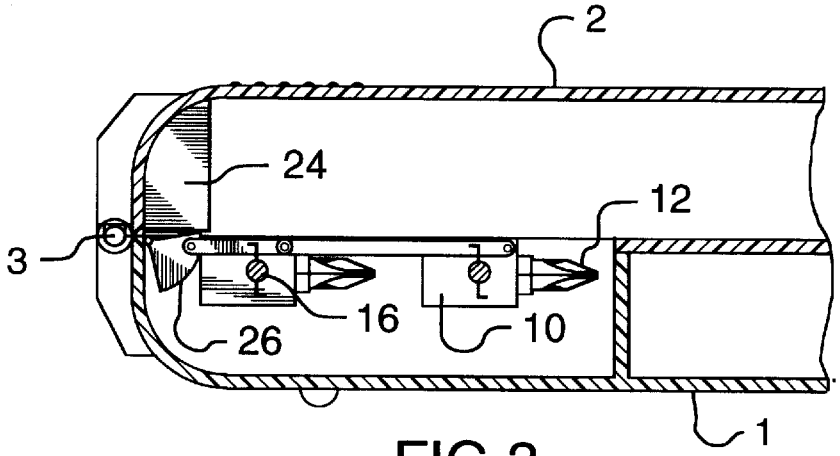
FIG. 3 is a side cross-section of the FIG. 1 tool case in the closed position.
Figure 4:
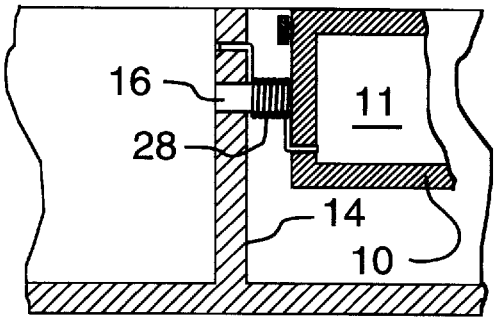
FIG. 4 is a front cross-section in the area of the side of one of the pivotable component holders.
Figure 5:
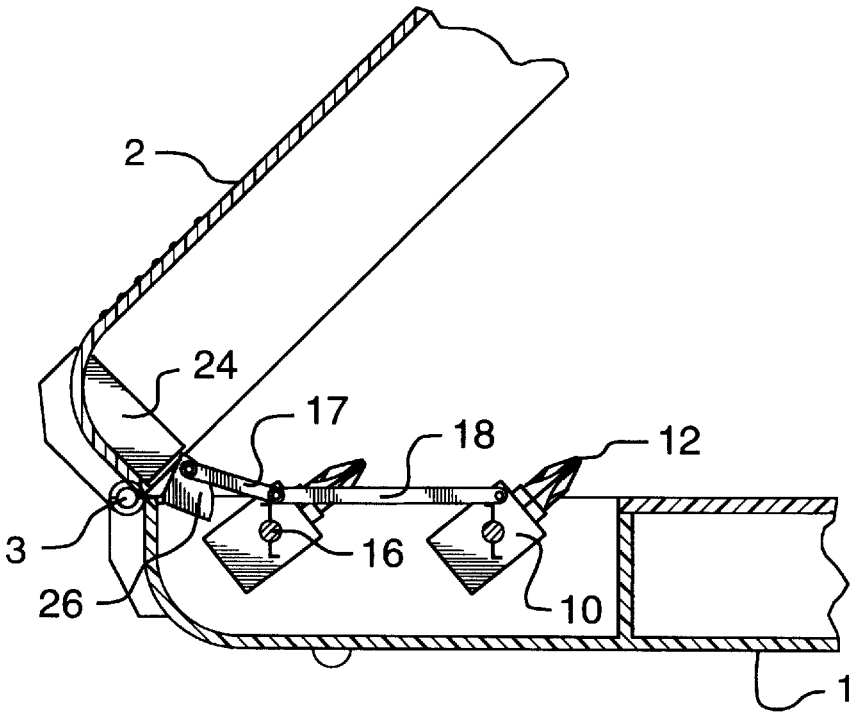
FIG. 5 is a side cross-section of the FIG. 1 embodiment, showing the tool case in the partially-open position.
Figure 6:
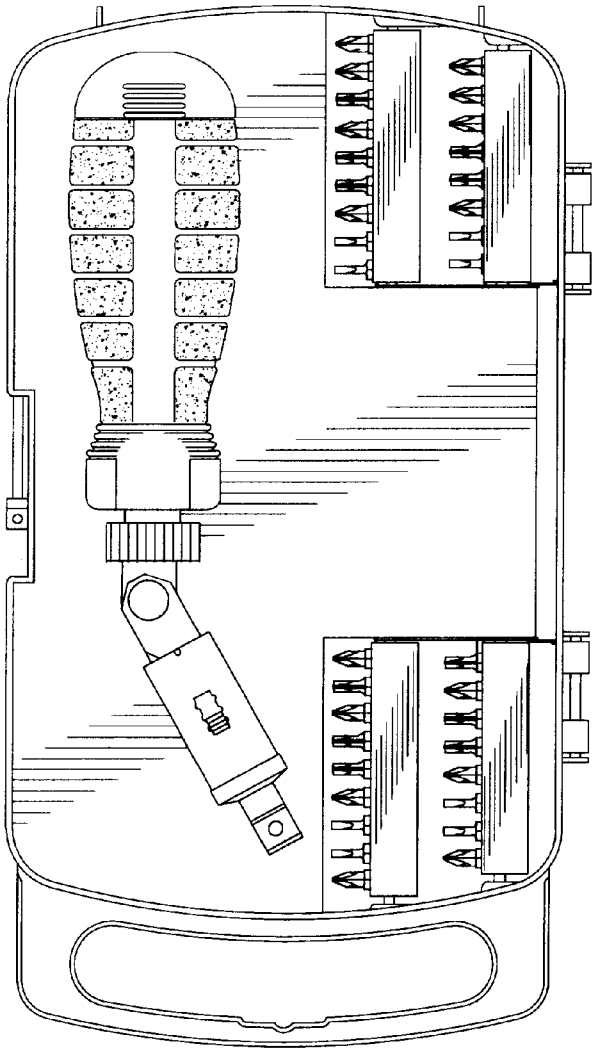
FIG. 6 is a plan view showing a tool case embodiment with rotating component holders at different locations within the tool container.
Figure 6A:
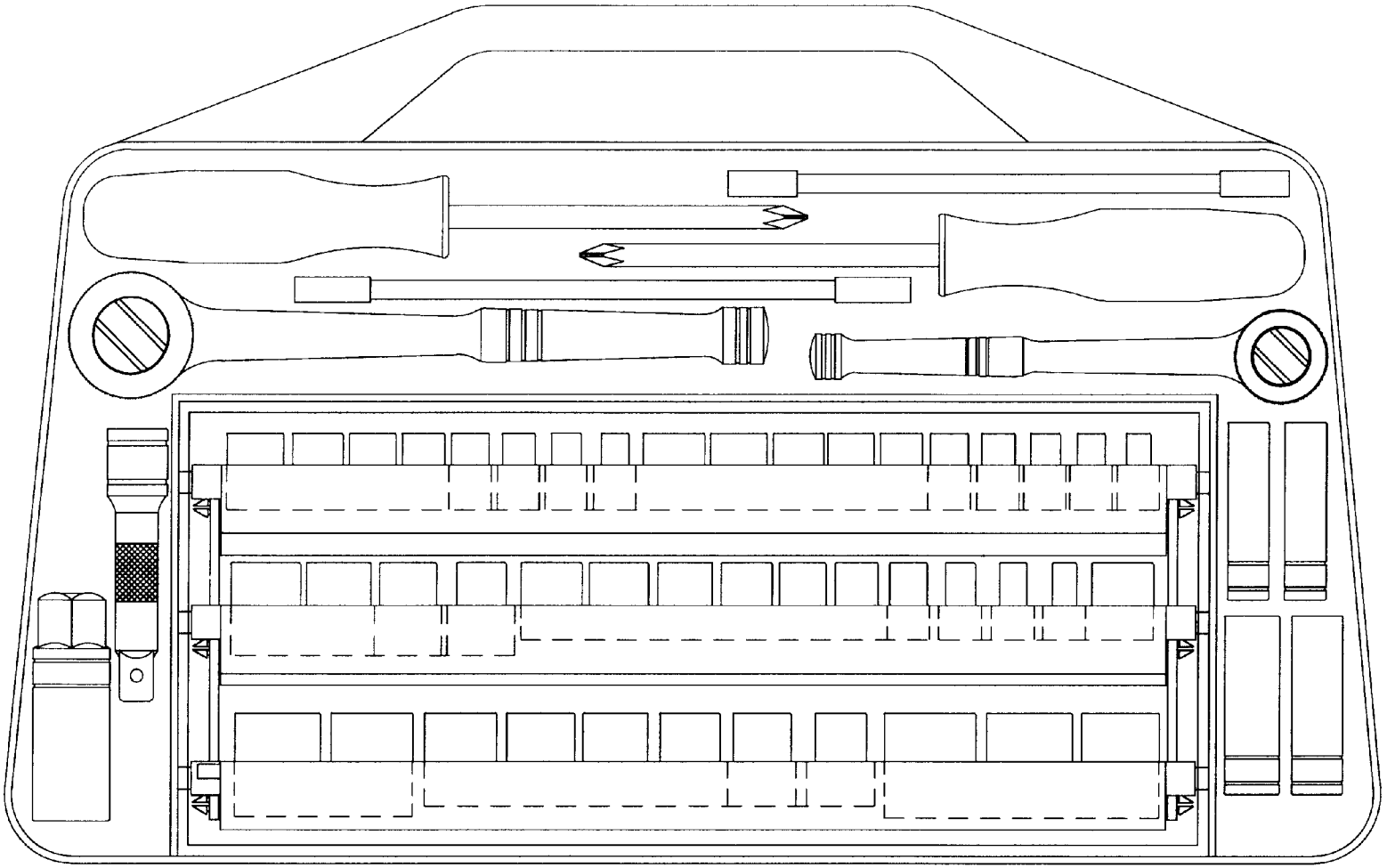
FIG. 6A is a plan view showing a second tool case embodiment with rotating component holders at different locations within the tool container.
Figure 7:
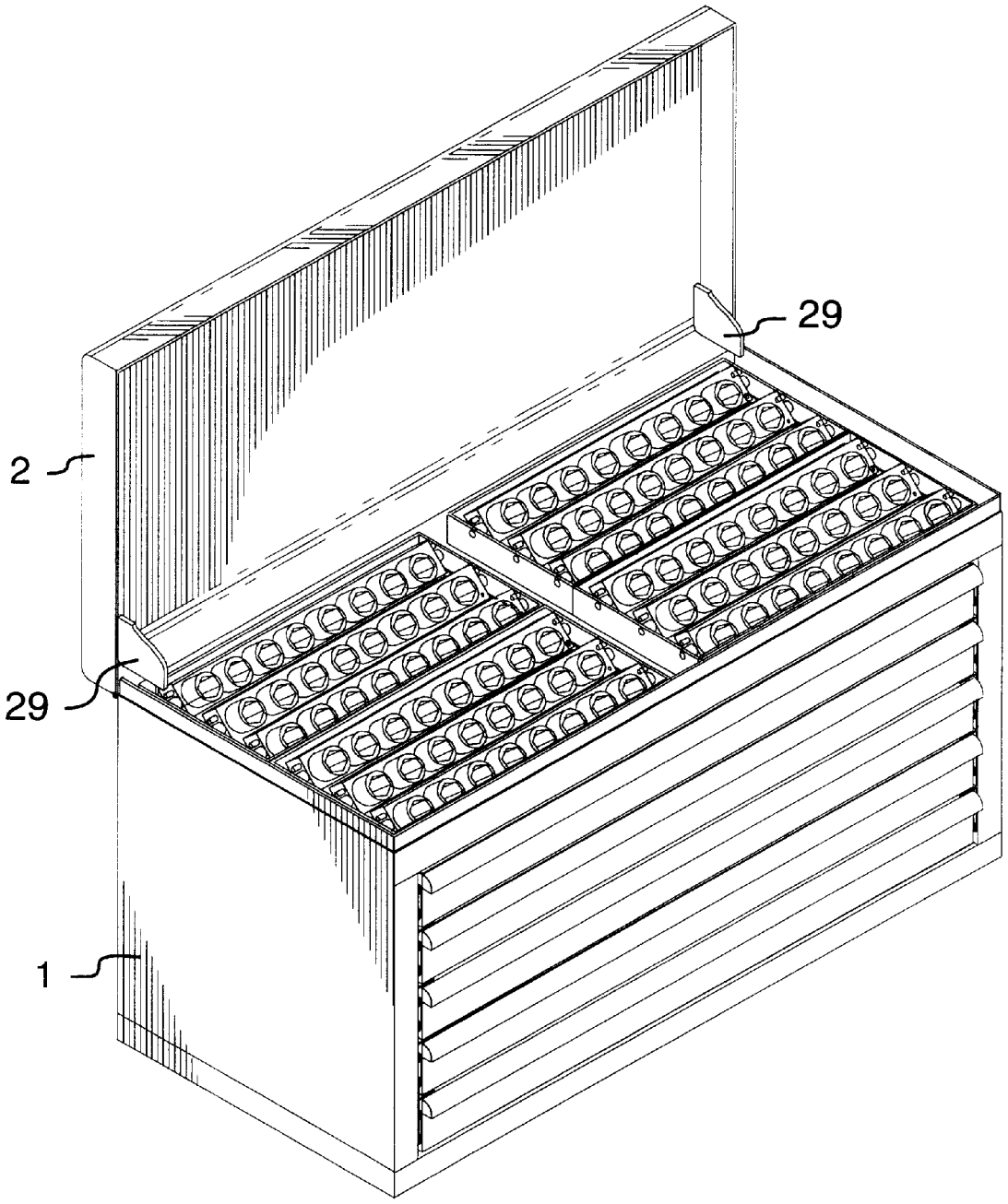
FIG. 7 is a perspective view showing a first embodiment of a toolbox lid, which uses a cam to actuate the rotation of the component holders.
Figure 8:
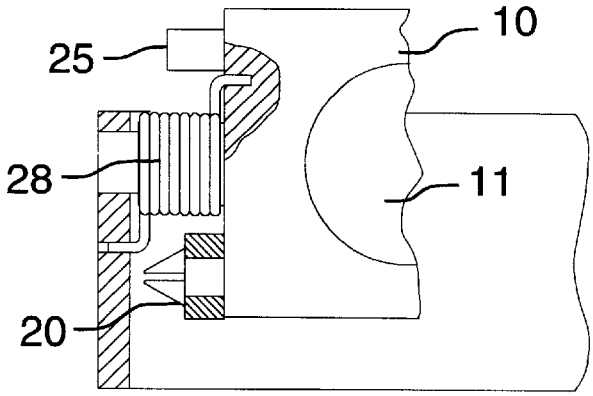
FIG. 8 is a cross-section showing a torsion spring at the side of a component holder.
Figure 9:
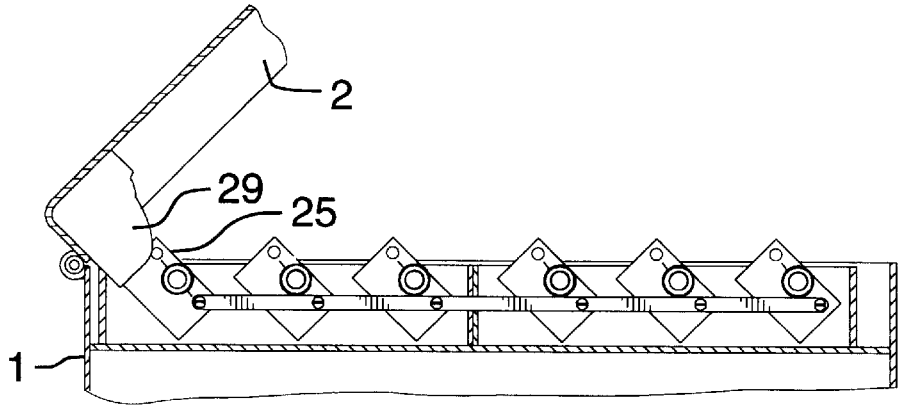
FIGS. 9 and 10 are side views showing the rotation of the component holders as the lid is closed.
Figure 10:
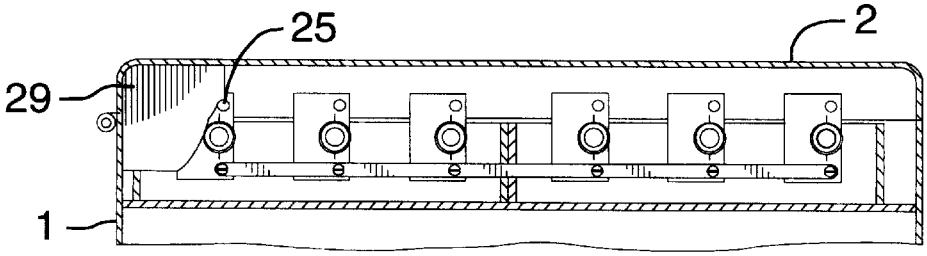
Figure 11:
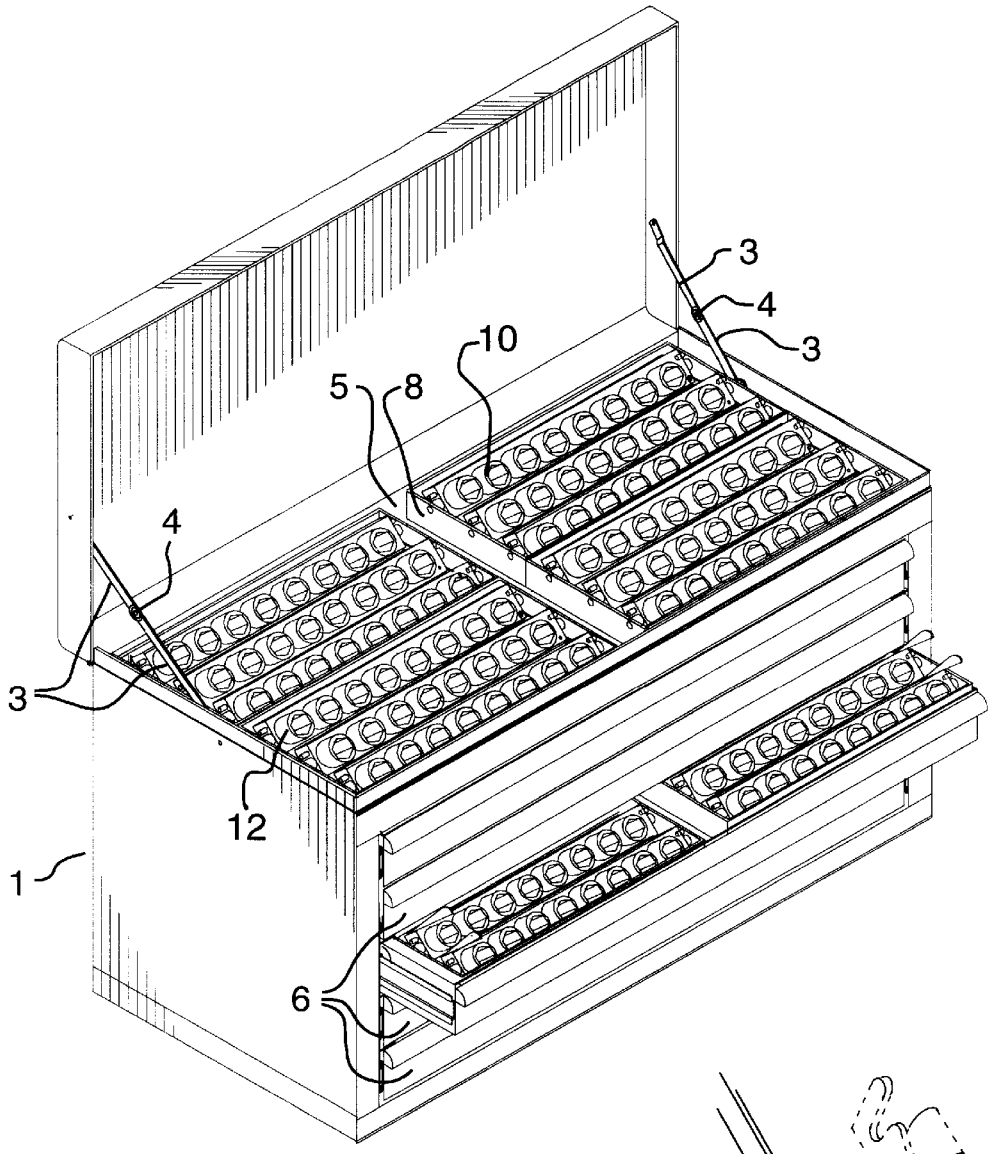
FIG. 11 is a perspective view of a second embodiment of a toolbox, which uses a clip on a linkage arm between the toolbox and its lid.
Figure 12:
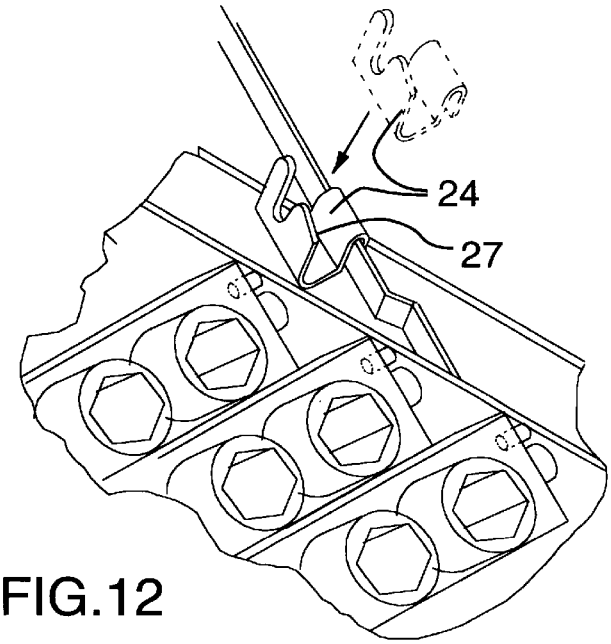
FIG. 12 is a perspective view showing the clip on the linkage arm between the toolbox and its lid.
Figure 13:
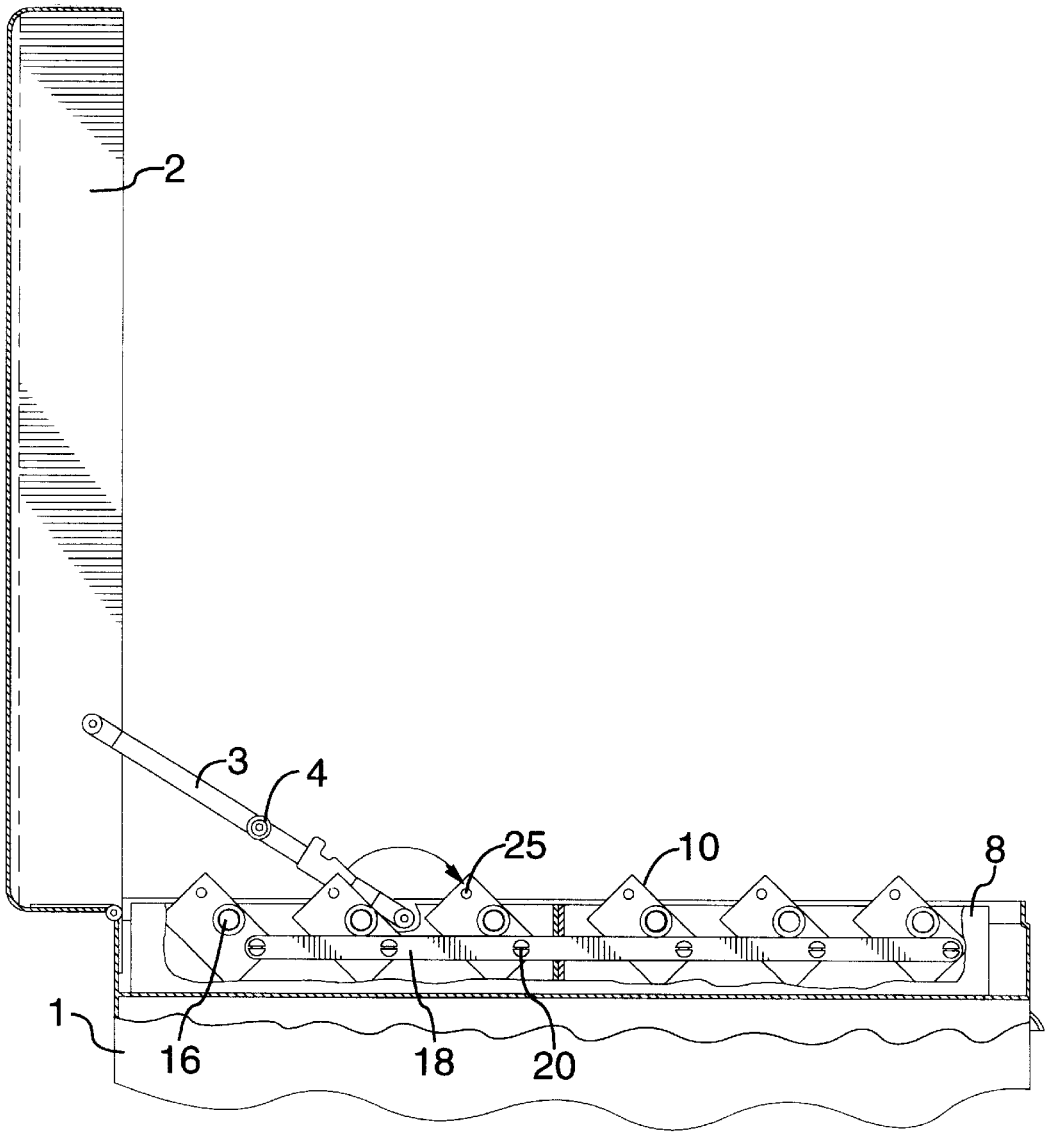
FIGS. 13–15 are side views showing the movement of the linkage arm and clip as the toolbox lid is closed.
Figure 14:
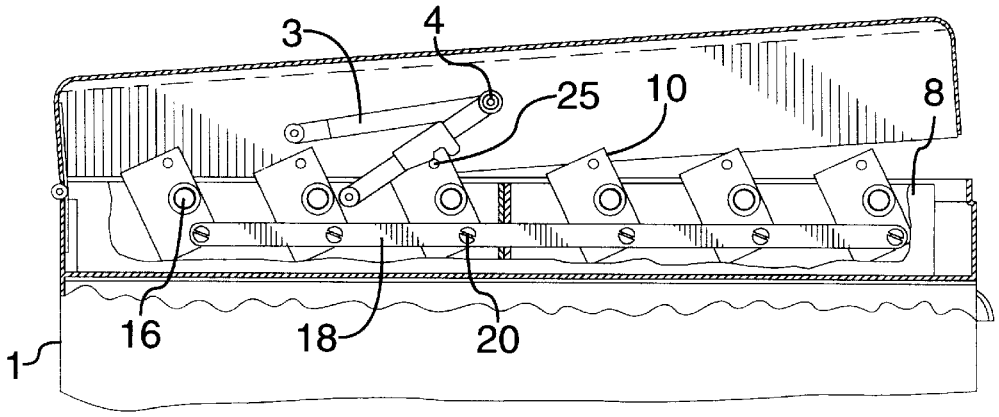
Figure 15:
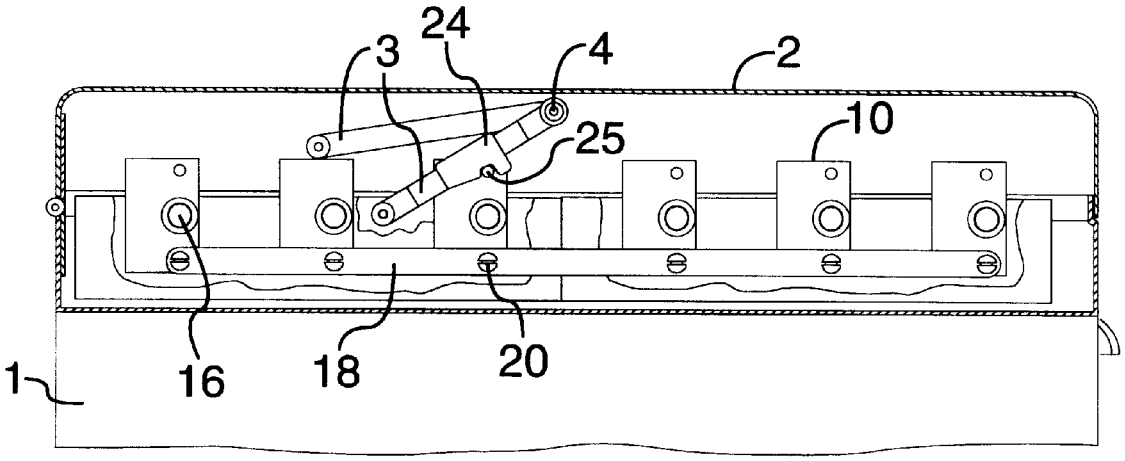
Figure 16A:
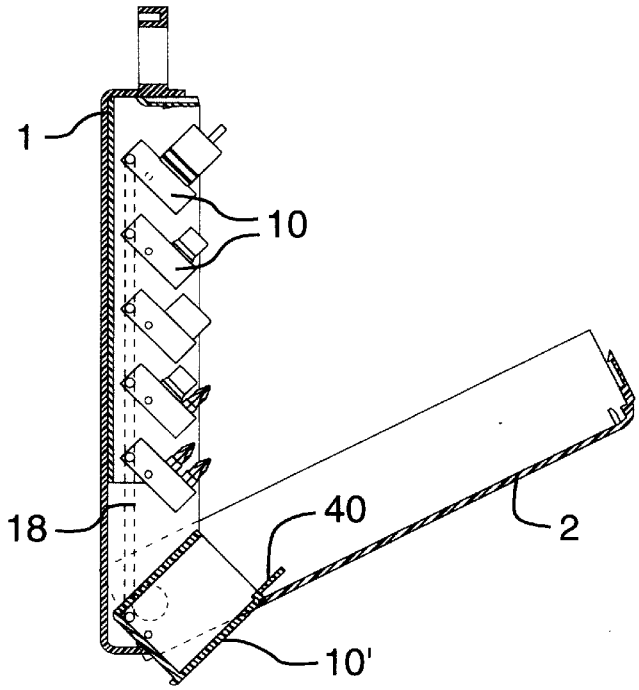
FIGS. 16A–16D are side cross-sections of a wall-mountable or bench-top container illustrating component holders with rotate open via gravity, and which are closed by closing the lid.
Figure 16B:
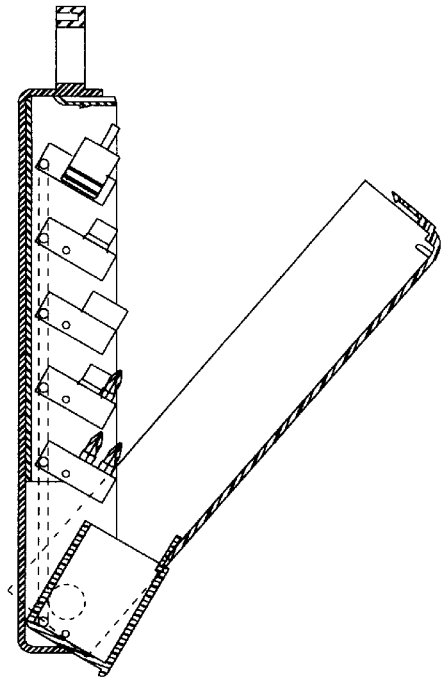
Figure 16C:
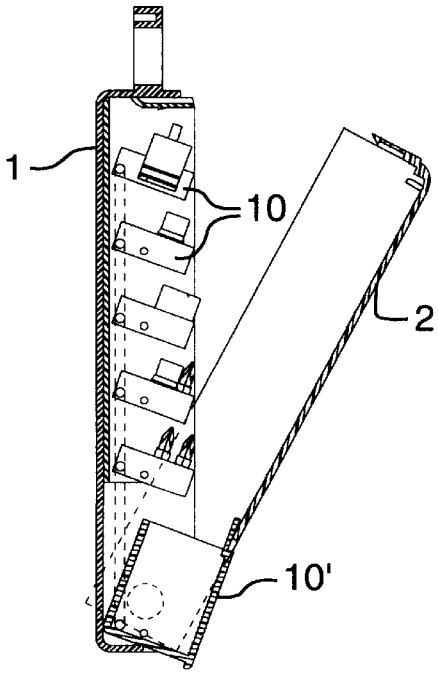
Figure 16D:
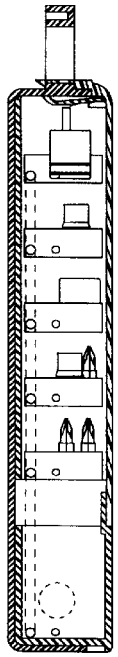

In the preferred embodiment of the tool case, shown in FIGS. 1–6, when the tool container is closed, a block 24 on the lid contacts a cam 26 which is rotated downwardly to push an actuation bar 17 into a position in which the first holder is rotated into a horizontal storage position, as seen in FIG. 3. By virtue of the gang bar(s) 18, this results in any additional holders also being rotated to the storage position. As seen in FIG. 4, a spring 28 may be mounted on at least one of the pivot pins 16, to bias the holders to an upwardly rotated position. Thus when the tool container is opened, such that the block no longer bears against the cam, the holders swing upwardly under the influence of the spring or springs. Alternatively, by suitable selection of the location of the pivot pins 16, the design may be such that gravity rotates the holders into their access position, so that no spring is required. Closing the lid then forces the holders into their storage position against the force of gravity instead of against the spring force.

In the preferred embodiment of the toolbox, shown in FIGS. 7–10, the principle is very similar. A cam 29 mounted on the lid is used as the means for contacting the pin 25, in this case the pin of the rearmost row of holders. This could be viewed as equivalent to the block 24, but shaped so as to avoid the need for a cam 26. The lid thus acts directly against the first holder (but with no direct connection thereto), with the remaining holders being ganged to the first holder.

In an alternative embodiment of the toolbox, shown in FIGS. 11–15, when the lid 2 is opened to expose the upper storage area 5, a clip 24 on the lower one of the linkage arms 3 releases a pin 25 on one of the pivotable holders 10. A torsion spring 28 or gravity then causes the holders to rotate upwardly. The holders are ganged together as mentioned above.

When the lid is moved towards the closed position, the angled surface 27 of the clip comes into contact with the pin 25, acting to gradually rotate the holder into its storage position. This sequence can be seen in FIGS. 13–15.

Figure 17A:
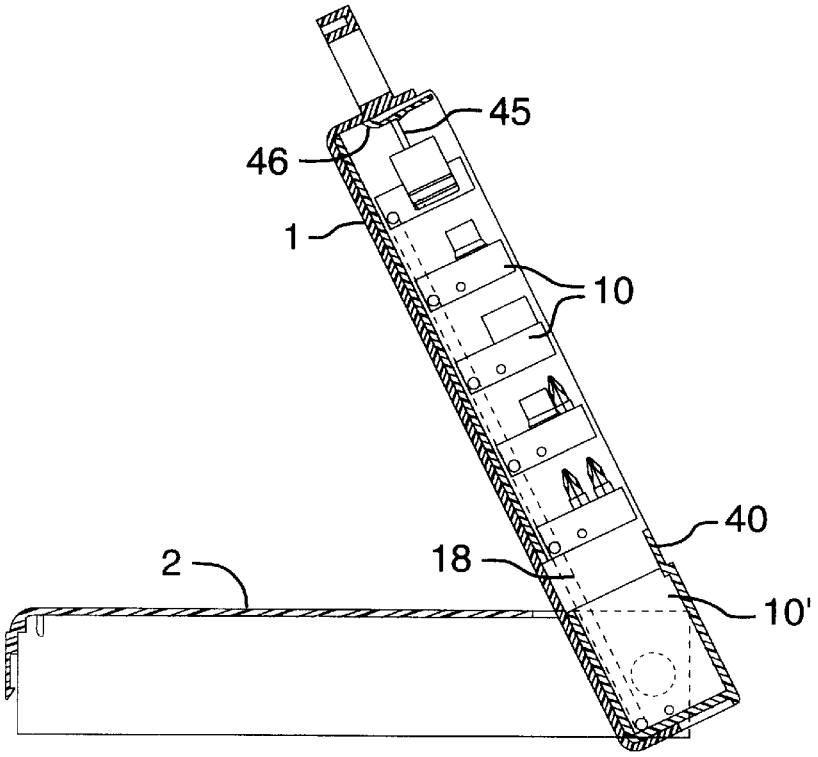
FIGS. 17A and 17B show an optional manual lock in the container of FIGS. 16A–16D.
Figure 17B:
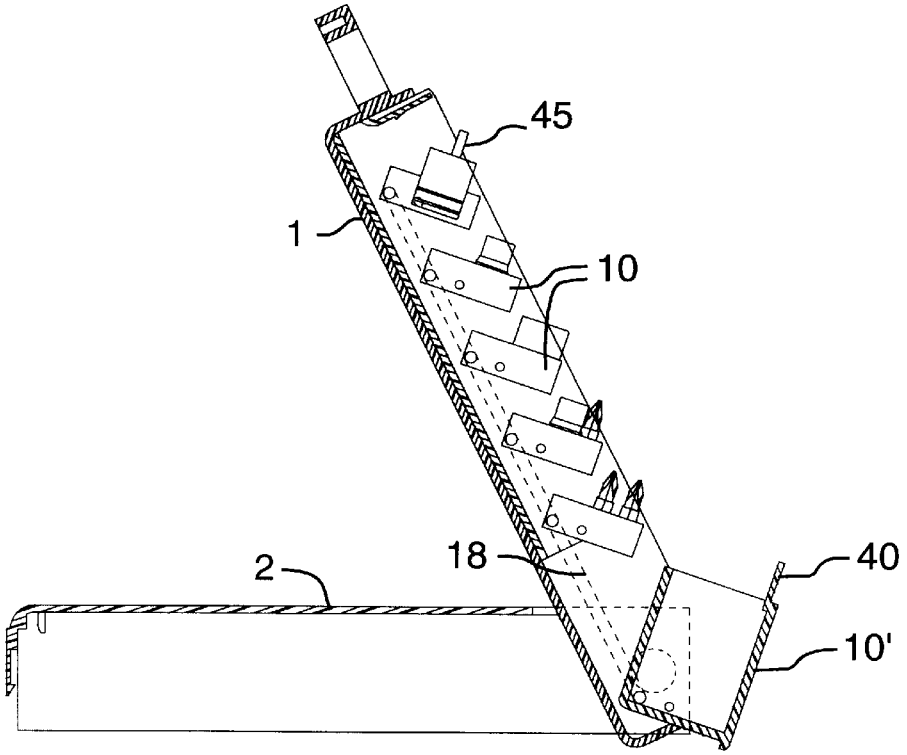

FIGS. 16A–16D and 17A–17B are side cross-sections showing a wall-mountable or bench-top container. FIGS. 16A–16D show the container oriented vertically, as it would be if mounted on a wall. FIGS. 17A and 17B show the container oriented at a slight angle from the vertical, as if positioned on a workbench with the cover 2 rotated past 270 degrees from its closed position so as to act as a support stand for the case. In this embodiment, the component holders are biased towards the access position when the lid is open. This biasing is preferably by virtue of gravity, but a spring could be used if desired. As well, component holders may be manually rotated, if desired. The component holders include a bottom bin 10'. When the cover is moved towards the closed position, the bottom edge of the cover comes into contact with a tab 40 which extends upwardly from the outer edge of the bottom bin. As the cover is closed, in the sequence shown in FIGS. 16A–16D, the contact between the cover and the tab gradually moves the bottom bin to its storage position. The surface of the cover 2 aligns with the outer surface of the bottom bin, such that visually the outer surface of the bottom bin becomes part of the cover.

In the same manner as in the other embodiments, the component holders 10 and the bottom bin 10' are ganged together, so that closing the cover also rotates these holders 10 into their storage position.

FIGS. 17A and 17B show an optional manual lock, in the form of a locking tab 45 projecting upwardly from the upper component holder, to be engaged by a manually-actuated catch 46. Releasing the catch 46 allows the component holders to rotate to their access positions. This feature gives the owner the option of removing the cover 2 entirely, and carrying the case from place to place with the component holders nevertheless still in their storage positions. On arriving at the work location, the owner simply release the catch 46 to gain access to the tool components.

Obviously, the tool container could have the actuation mechanism at one location, with one component holder, or there could be several ganged holders as in the preferred embodiment, or there could be several holders at different locations within the tool container, actuated by separate mechanisms (as in FIGS. 6 and 18), or by the same mechanism centrally located between the holders.

Figure 18:
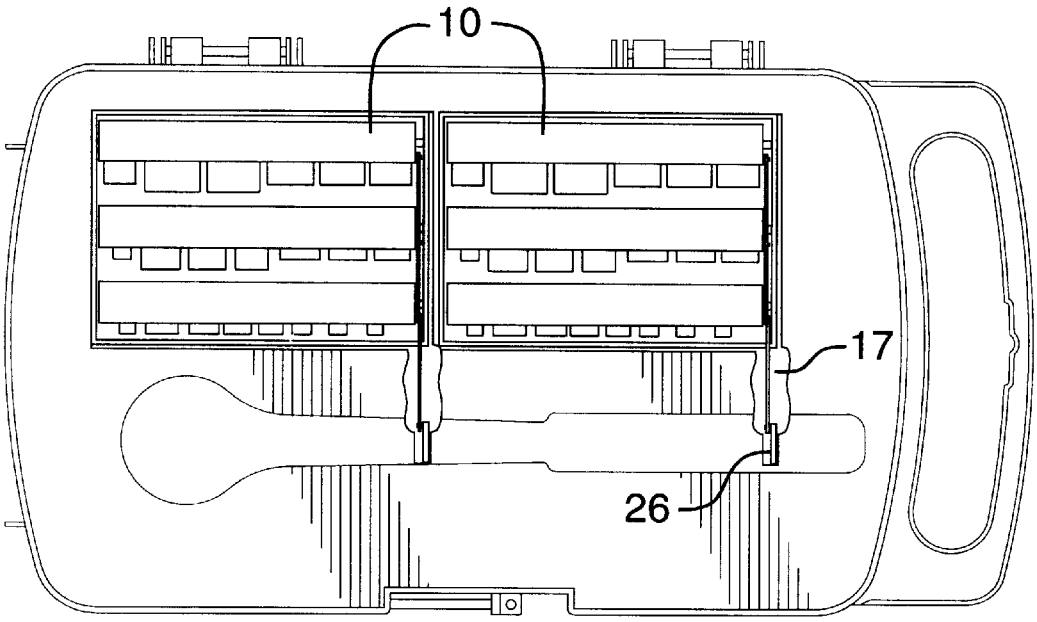
FIG. 18 is a plan view showing a tool case where the mechanism is actuated not by lifting the lid, but by removing a tool.
Figure 19:
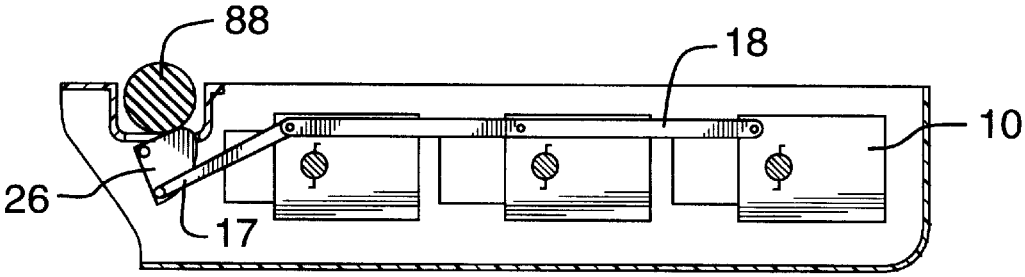
FIG. 19 is a side cross-section of the FIG. 18 tool case, showing the weight of the tool holding the cam down and hence holding the component holders in the storage position.
Figure 20:
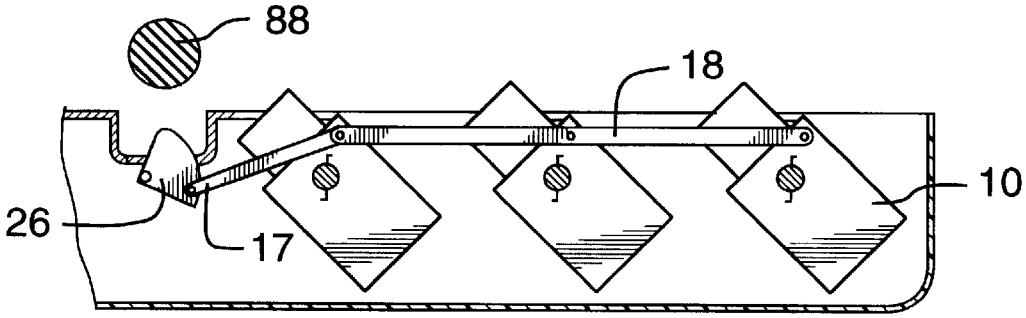
FIG. 20 is a side cross-section of the FIG. 18 tool case, showing the tool lifted, such that the component holders are free to rotate from the storage position.

Yet another alternative would be as shown in FIGS. 18–20. In this embodiment, the weight of the tool 88 holds down the cam 26. By virtue of the actuation bar 17 and gang bar 18, this results in the holders being held in their storage positions. When the tool is removed, springs or gravity produce rotation of the component holders.

FIGS. 21–22 show an alternative ganging means to the use of a gang bar. In FIGS. 21–22, ganged motion is brought about by pins 85 riding in appropriately-shaped slots 84 of adjacent holders 10. Rotation of one of the holders causes movement of its pin 85 which causes corresponding rotation of the adjacent holder by virtue of the position of the pin of the first holder in the slot 84 of the adjacent holder.

Figure 24:
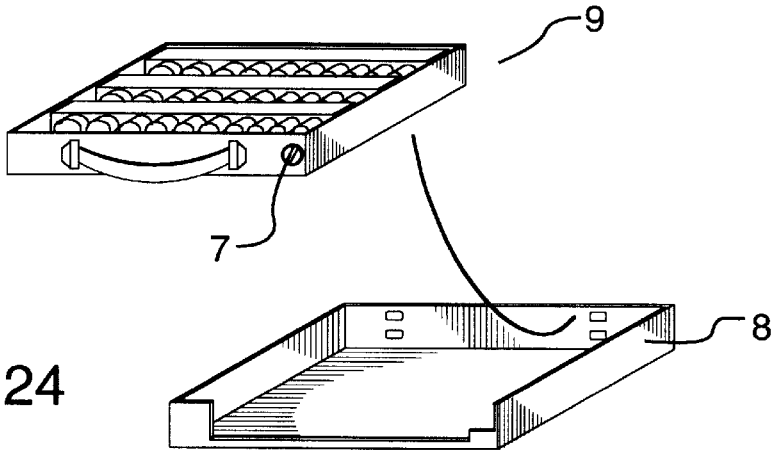
FIG. 24 is a perspective view of the removable tool component tray and the main tray.
Figure 24A:
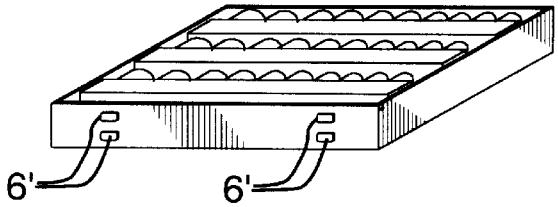
FIG. 24A is a rear perspective view of the removable tool component tray.

FIGS. 23–27 show a third embodiment of a toolbox, wherein a component holder tray 9 is detachable from a main tray 8 positioned within the toolbox. In the same manner as in the other embodiments, the tool component holders are ganged together, so that closing the cover also rotates these holders, on the upper most tray, into their storage position. However, in this embodiment of the invention, the user may advantageously detach the removable tool component tray 9 from the rest of the toolbox and use it, for example, alongside the user under a car. FIGS. 24 and 24A illustrates how the removable tool component tray 9 is slidably mounted within the main tray 8 via tabs 6' that register with corresponding receiving apertures in the rear of the main tray 8. Alternatively, the main tray may not be necessary. Instead, the removable tray can be slidably mounted into corresponding receiving apertures adapted to the toolbox.

Figure 25:
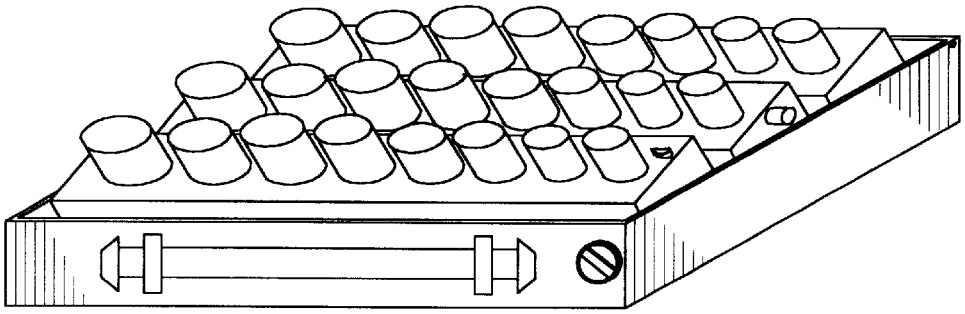
FIG. 25 is a front perspective view of the removable tool component tray with the locking knob in an open position and the component holders rotated upwards.
Figure 26:
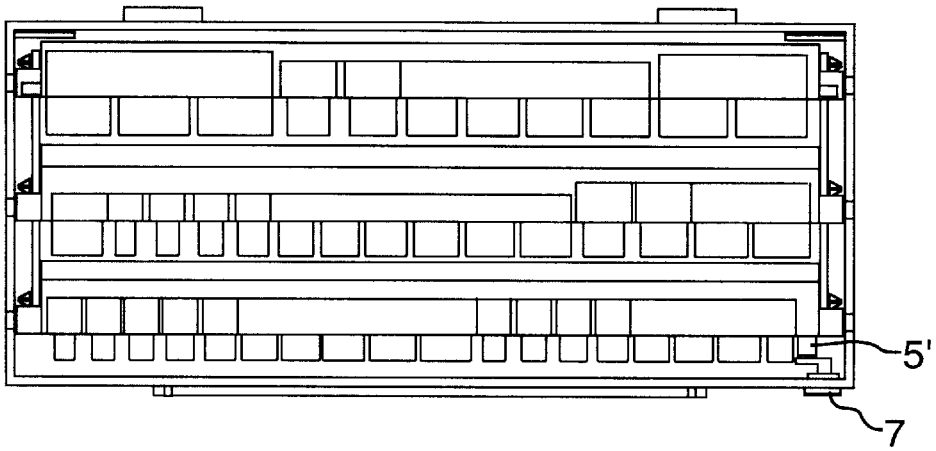
FIG. 26 is a plan view of the removable tool component tray.
Figure 27:
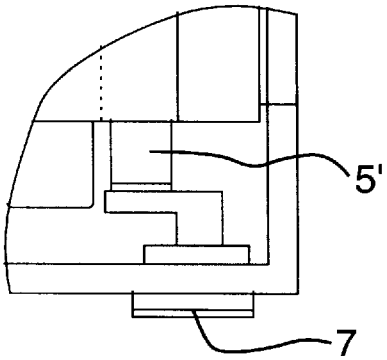
FIG. 27 is a close-up plan view of the locking knob mechanism.
Figure 28A:
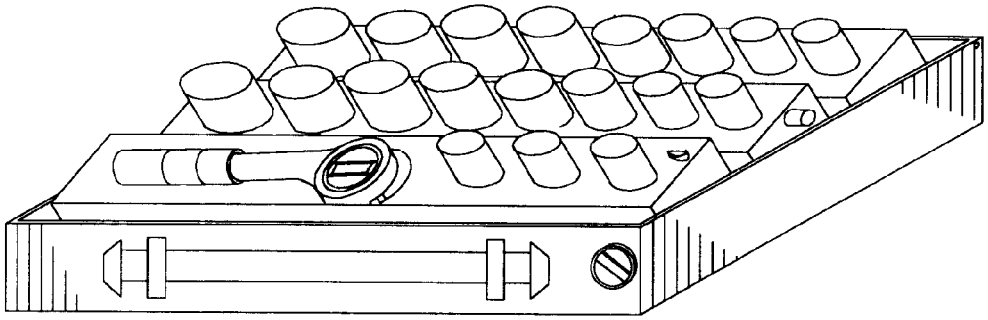
FIGS. 28A–28B are perspective views of alternative embodiments of the removable tool component tray.
Figure 28B:
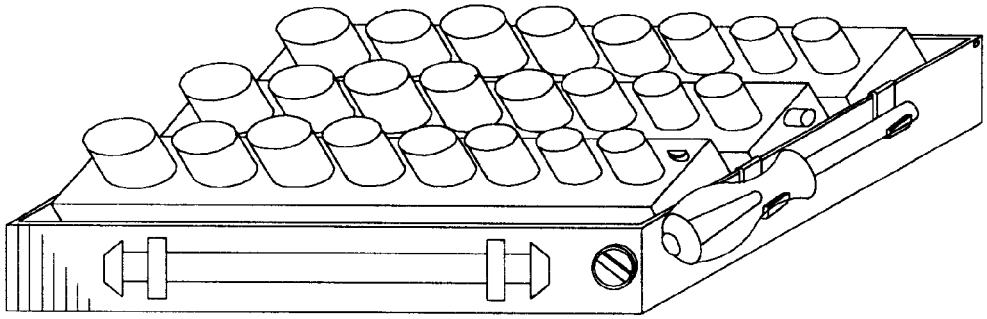

FIG. 25 shows the removable tool component tray with the locking knob in an open position and the component holders rotated upwards and readily accessible to the user. In the case where the removable trays are used in conjunction with the drawers of the toolbox, for short components, the component holders are normally angularly displaced, whereas, for long components, it is necessary to store them horizontally and rotate the same when desired. In the case when the removable tool component tray is detached from the toolbox, and when the tool components are desired to be in their stored position, they are manually reset into the storage position and locked into that position by setting the locking knob 7' to a close position as shown in FIGS. 26–27. The locking means 5' includes a stop that resists any movement of the tool component holders upwards. As shown in FIGS. 28A–28B are alternative embodiments of the removable tool component tray wherein large tools may be adapted onto the removable tool component tray.

It should be clearly understood that it is not presently intended that the invention be limited to specific means of achieving the rotation. In addition to the specific means described above and illustrated in the drawings, obviously there are many other similar mechanisms which could be employed which would be equally effective. The essence is pivoting of the component holders actuated by opening a lid or cover or by removing a tool, with no direct linkage between the lid or cover or tool and the component holders themselves.

What is claimed as the invention is:

1. A tool container, comprising a base and a lid connected thereto for movement between open and closed positions, said base having at least one pivotable component holder pivotally mounted therein for pivoting movement between a storage position and an access position, each said pivotable component holder being biased towards said access position when said lid is open, said tool container having actuation means, said actuation means comprising a first element on said lid arranged to come into contact with a second element operatively associated with a said pivotable component holder to rotate said pivotable component holder, so as to gradually rotate said pivotable component holder to its storage position as said lid closes.

2. A tool container as recited in claim 1, wherein said first element comprises a cam projecting from said lid.

3. A tool container as recited in claim 2, wherein said second element comprises a pin extending from at least one side of said pivotable component holder.

4. A tool container as recited in claim 3, comprising at least two pivotable component holders, ganged with said pivotable component holder by ganging means.

5. A tool container as recited in claim 4, where said ganging means is a gang bar connecting said pivotable component holders.

6. A tool container as recited in claim 4, where said ganging means comprises a pin on said pivotable component holder riding within a slot on an adjacent pivotable component holder, said slot being appropriately shaped such that rotation said pivotable component holder produces corresponding rotation of said adjacent pivotable component holder by contact between said pin and walls of said slot.

7. A tool container as recited in claim 2, comprising at least two pivotable component holders, ganged with said pivotable component holder by ganging means.

8. A tool container as recited in claim 7, where said ganging means is a gang bar connecting said pivotable component holders.

9. A tool container as recited in claim 7, where said ganging means comprises a pin on said pivotable component holder riding within a slot on an adjacent pivotable component holder, said slot being appropriately shaped such that rotation said pivotable component holder produces corresponding rotation of said adjacent pivotable component holder by contact between said pin and walls of said slot.

10. A tool container as recited in claim 1, comprising at least two pivotable component holders, ganged with said pivotable component holder by ganging means.

11. A tool container as recited in claim 10, where said ganging means is a gang bar connecting said pivotable component holders.

12. A tool container as recited in claim 10, where said ganging means comprises a pin on said pivotable component holder riding within a slot on an adjacent pivotable component holder, said slot being appropriately shaped such that rotation said pivotable component holder produces corresponding rotation of said adjacent pivotable component holder by contact between said pin and walls of said slot.

13. A tool container as recited in claim 1, wherein said second element comprises a cam pivotally mounted in said base, connected to said pivotable component holder by an actuation bar, rotation of said cam causing movement of said bar and thence rotation of said pivotable component holder.

14. A tool container as recited in claim 13, comprising at least two pivotable component holders, ganged with said pivotable component holder by ganging means.

15. A tool container as recited in claim 14, where said ganging means is a gang bar connecting said pivotable component holders.

16. A tool container as recited in claim 14, where said ganging means comprises a pin on said pivotable component holder riding within a slot on an adjacent pivotable component holder, said slot being appropriately shaped such that rotation said pivotable component holder produces corresponding rotation of said adjacent pivotable component holder by contact between said pin and walls of said slot.

* * * * *